US008028488B2

(12) United States Patent
Dodd

(10) Patent No.: US 8,028,488 B2
(45) Date of Patent: Oct. 4, 2011

(54) FOLDABLE TRUSS

(75) Inventor: Mark C. Dodd, Pendleton, IN (US)

(73) Assignee: Tyler Truss Systems, Inc., Pendleton, IN (US)

( * ) Notice: Subject to any disclaimer, the term of this patent is extended or adjusted under 35 U.S.C. 154(b) by 420 days.

(21) Appl. No.: 12/265,153

(22) Filed: Nov. 5, 2008

(65) Prior Publication Data

US 2010/0064624 A1 Mar. 18, 2010

Related U.S. Application Data

(60) Provisional application No. 61/097,339, filed on Sep. 16, 2008.

(51) Int. Cl.
*E04H 12/18* (2006.01)

(52) U.S. Cl. ..... 52/645; 52/633; 52/646; 52/651.01; 52/653.1; 52/653.2; 52/648.1; 52/128

(58) Field of Classification Search ..... 52/633, 52/645, 646, 651.01, 653.1, 653.2, 648.1; 135/122, 128

See application file for complete search history.

(56) References Cited

U.S. PATENT DOCUMENTS

| | | | | |
|---|---|---|---|---|
| 1,141,385 | A | 6/1915 | Ellinger | |
| 2,982,379 | A | 5/1961 | Fisher | |
| 3,011,586 | A * | 12/1961 | Harvey, Jr. | 182/115 |
| 3,783,573 | A * | 1/1974 | Vaughan | 52/646 |
| 4,352,255 | A * | 10/1982 | Warehime | 446/120 |
| 4,541,509 | A | 9/1985 | D'Alessio et al. | |
| 4,575,975 | A * | 3/1986 | Eisenberg | 52/109 |
| 4,790,113 | A | 12/1988 | Gregory | |
| 4,819,399 | A * | 4/1989 | Onoda | 52/646 |
| 4,912,887 | A * | 4/1990 | Sullivan | 52/7 |
| 5,125,206 | A * | 6/1992 | Motohashi et al. | 52/646 |
| 5,243,803 | A * | 9/1993 | Tabata et al. | 52/646 |
| 5,335,467 | A * | 8/1994 | Oberman et al. | 52/645 |
| 5,444,946 | A * | 8/1995 | Zeigler | 52/86 |
| 5,711,131 | A * | 1/1998 | Thomas | 52/656.9 |
| 6,076,770 | A * | 6/2000 | Nygren et al. | 244/159.5 |
| 6,173,726 | B1 * | 1/2001 | Talmadge | 135/144 |
| 6,321,501 | B1 * | 11/2001 | Ignash | 52/645 |
| 6,374,843 | B1 * | 4/2002 | Zou | 135/145 |
| 6,779,538 | B2 * | 8/2004 | Morgante et al. | 135/128 |
| 7,044,146 | B2 * | 5/2006 | Losi, Jr. | 135/145 |
| 7,963,084 | B2 * | 6/2011 | Merrifield et al. | 52/646 |
| 2004/0144413 | A1 * | 7/2004 | Matthews et al. | 135/131 |
| 2005/0262779 | A1 * | 12/2005 | Zeigler | 52/109 |

* cited by examiner

*Primary Examiner* — Brian Glessner

*Assistant Examiner* — Gisele Ford

(74) *Attorney, Agent, or Firm* — Woodard Emhardt Moriarty McNett & Henry LLP

(57) ABSTRACT

A foldable truss having a pair of side frames hinged together by a foldable arm allowing the truss to be collapsed to a smaller width while maintaining the truss length as a constant.

14 Claims, 5 Drawing Sheets

FOLDABLE TRUSS

This application is based on provisional patent application Ser. No. 61/097,339, filed Sep. 16, 2008.

BACKGROUND OF THE INVENTION

1. Field of the Invention

This invention is in the field of trusses used to support a variety of appliances, such as lights.

2. Description of the Prior Art

Various staging systems are used in the production and managing of events for every shape and size including all types of entertainment, such as, concerts, dance, theatre, comedy, etc. Typically, large scale truss assemblies support, above the staging area, various appliances including lighting fixtures used during the performance.

A minimum amount of time is allocated to the erection of staging systems since access to a performance site is limited. Thus, the truss must arrive at the performance site in a condition ready to be hoisted into place.

Trusses are transported to the performance site in the assembled state thereby requiring a relatively large amount of storage space within the transportation vehicle due to the size of each truss. A typical truss used in staging systems is approximately 36 inches wide and 42 inches in length. Some of the prior trusses have been designed to partially minimize the amount of space occupied by the truss in the transportation vehicle by allowing one side of the truss to move not only toward the other side of the truss, but also along its length since the cross members linking the truss side are not flexible and pivot on each side in the direction of the longitudinal axis of the truss. The result is a decrease in the width of the truss occupied in the storage vehicle; however, the length of the truss dramatically increases requiring large storage space. Disclosed herein is a foldable truss allowing the truss sides to move toward each other while the truss sides do not move in the direction of the longitudinal axis of the truss. Thus, the space in the transportation vehicle occupied by the truss is minimized since the width of the truss is decreased while the length of the truss remains constant. An example of a column or girder wherein the length increases as the column or girder is folded to a storage condition is disclosed in U.S. Pat. No. 1,141,385 issued to J. O. Ellinger. An example of two members moving toward each other while also moving along the longitudinal axis of the assembly by disassembly of diagonal cross supports extending between the two members is disclosed in U.S. Pat. No. 4,790,113 issued to R. K. Gregory.

A variety of products include a plurality of rod shaped members connected together by cross members removably mounted by means of conventional fasteners, such as bolts and nuts. For example, in U.S. Pat. No. 4,541,509 issued to D'Alessio et al and U.S. Pat. No. 3,011,586 issued to J. E. Harvey, Jr., the cross members may be removed from the sides of the product. U.S. Pat. No. 2,982,379 issued to R. E. Fisher discloses a folding tower having hinged cross members connected together and secured by a slidable sleeve extending over the hinge.

What is needed is a truss that may be collapsed decreasing the truss width and maintaining the truss length without requiring all of the cross members connecting the opposite sides of the truss from being disassembled.

SUMMARY OF THE INVENTION

A foldable truss has a first truss end and an opposite second truss end with a longitudinal axis extending from the first truss end to the second truss end and comprising a first side frame and a second side frame. A first foldable support has a first end and an opposite second end where the first end is movably mounted to the first side frame and the second end is movably mounted to the second side frame. The support extends from the first side frame to the second side frame aligning the first side frame and second side frame across from each other wherein the truss has a length and spacing the first side frame and the second side frame apart wherein the truss has a width. A first hinge is located on the support between the first end and the second end having a locked in-use position maintaining the width and the length and an unlocked position wherein the first side frame and the second side frame move toward each other for storage decreasing the width while maintaining the length constant.

DESCRIPTION OF THE PREFERRED EMBODIMENT

Figure 1:
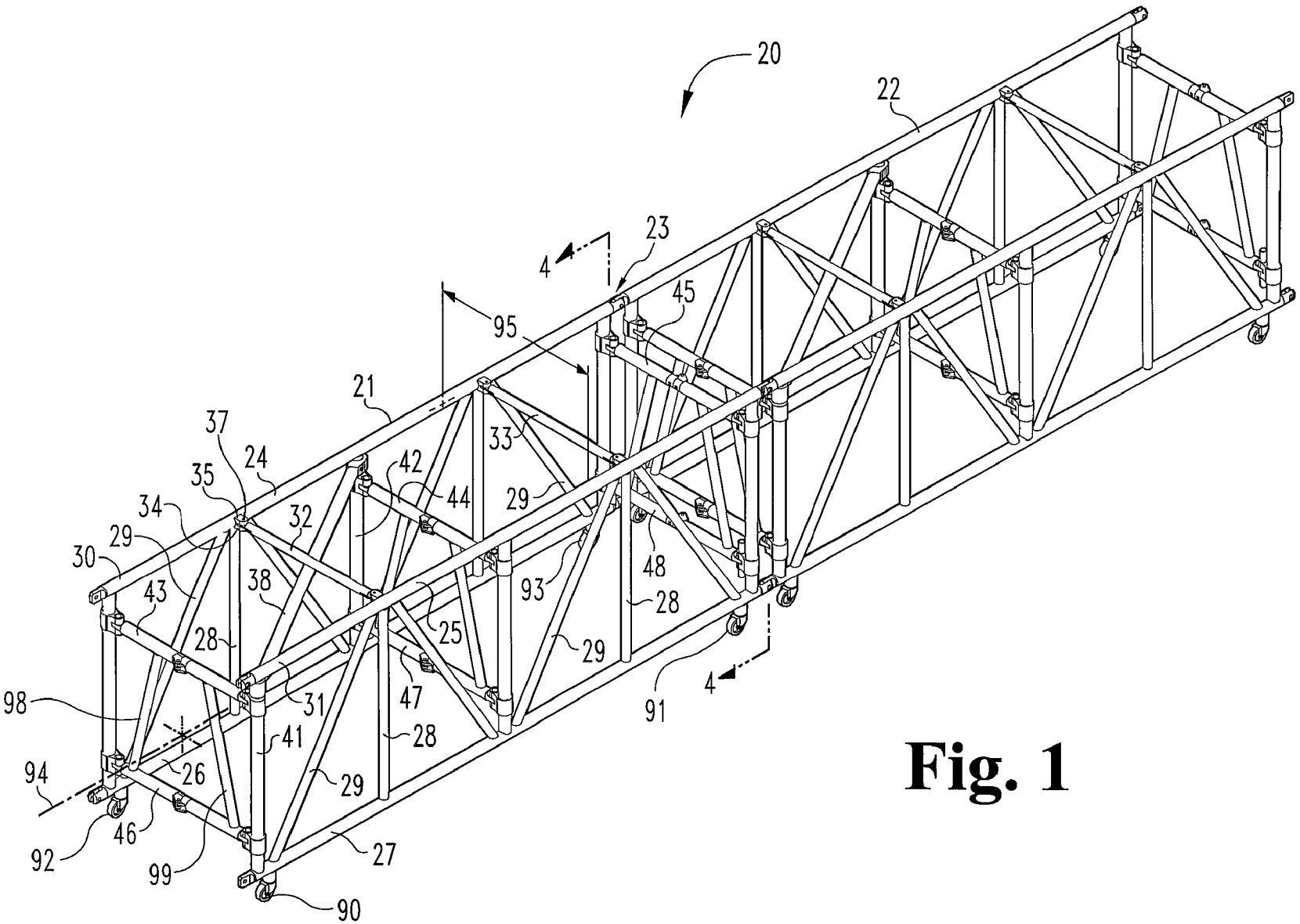
FIG. 1 is a perspective view of a truss assembly including two identical trusses connected together.
Figure 3:
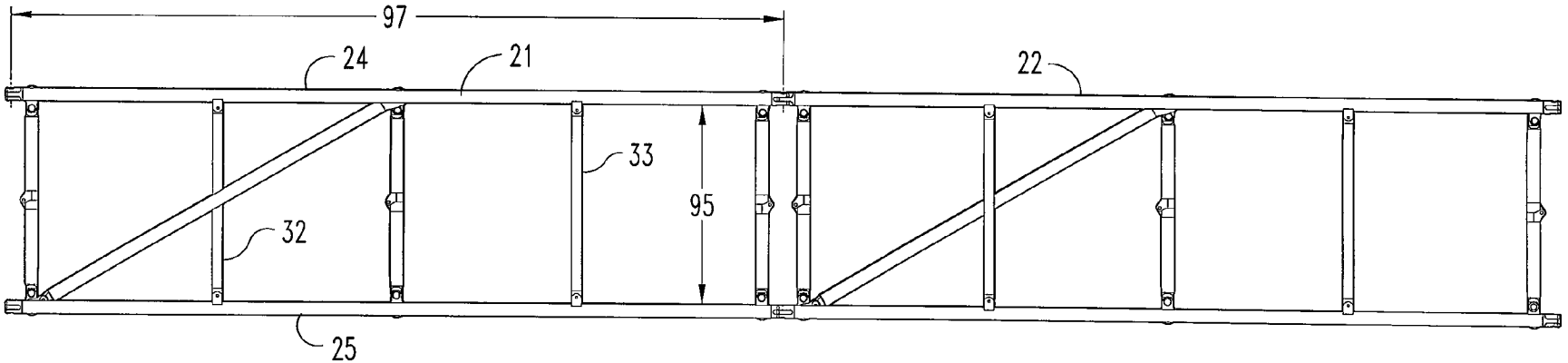
FIG. 3 is a top view thereof.
Figure 2:
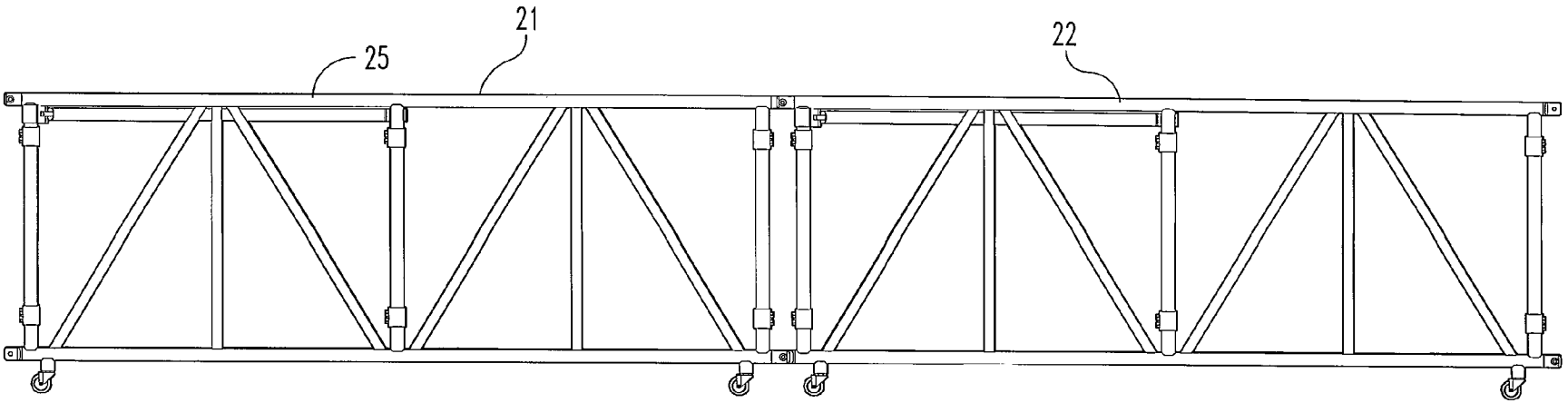
FIG. 2 is a side view thereof.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the drawings, there is shown the preferred embodiment of a truss assembly 20 including a pair of identical trusses 21 and 22 connected together at their adjacent ends 23 by mating flanges and removable pins extending through the flanges. The present invention includes a single truss 21 or 22 or when the trusses 21 and 22 are connected to form a single truss 20. Trusses 21 and 22 are aligned along the longitudinal axis 94 of the truss and extend parallel with the axis 94.

Truss 21 will now be described it being understood that an identical description applies to truss 22. Truss 21 includes four side members 24 through 27 extending longitudinally in the direction of the longitudinal axis 94 and are parallel therewith. Side member 24 is spaced apart and integrally attached to side member 26 by a plurality of vertically extending members 28 having their opposite ends integrally attached to side members 24 and 26. Likewise, members 25 and 27 are spaced apart and are integrally attached to the opposite ends of four additional vertical members 28. A plurality of diagonally extending members 29 have their opposite ends integrally attached to side members 24 and 26. Further, additional diagonal members 29 have their opposite ends integrally attached to side members 25 and 27. Conventional castor wheels 90 and 91 are pivotally mounted to member 27 and conventional castor wheels 92 and 93 are pivotally mounted to member 26.

A side frame 30 is therefore provided including side members 24 and 26 joined together by the diagonal members 29 and the vertically extending member numbers 28. Likewise, second side frame 31 is formed by side numbers 25 and 27 integrally attached to vertical numbers 28 and diagonal numbers 29.

In the embodiment shown in FIG. 1, side frame 30 is spaced apart and aligned with side frame 31 and is kept in place by two rods 32 and 33 having their opposite ends mounted by a pin and flange combination to side members 24 and 25. For example, a pair of spaced apart flanges 34 and 35 fixedly mounted to the inner side of side member 24 with the flange shaped end of rod 32 extending therein and secured thereto by a removable pin 37 extending through flanges 34,35. The opposite end of rod 32 is likewise pinned by a pair of flanges mounted to the inside surface of member 25. Either end of cross member 32 may be unfastened by removing the pin and pivoting the cross member adjacent to the side member 24 or 25 to which it is pivotally mounted.

Figure 5:
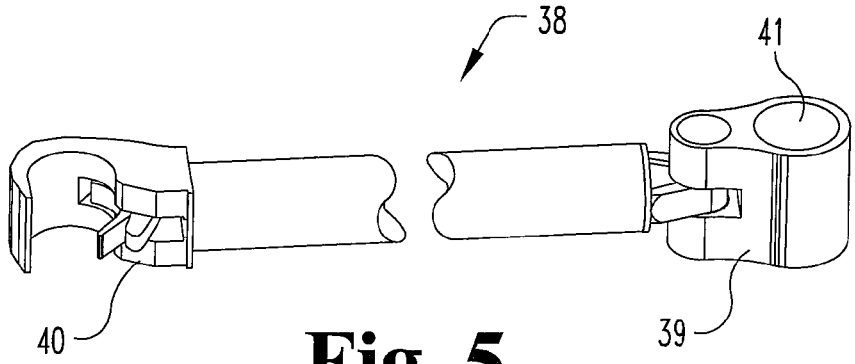
FIG. 5 is a fragmentary, enlarged view of a diagonal member mounted to the top of an individual truss.

Truss 21 includes a top diagonally extending member 38 having a first sleeve 39 (FIG. 5) extending around the vertical member 28 located at end 41 with the opposite end 40 formed as an open hand that removably and releasably extends around a vertical member 42 extending between and integrally joined to side members 24 and 26. End or hand 40 is commercially available from Aliscaff Ltd, Kenrich House, Elizabeth Way, Harlow, Essex, CM19 5TL, United Kingdom and is referred to as a Hook Fitting.

Hand 40 includes a curved inner surface 101 (FIG. 9) and an inwardly facing curved surface 109 formed on finger 102. Finger 102 is pivotally mounted to hand 40 and includes a helical spring 103 engaging the inner end of finger 102 thereby normally forcing the tip 107 to move away from surface 101 creating gap 108. Member 38 may be pivoted about side frame end 41 (FIG. 1) moving hand 40 adjacent vertical member 42 and allowing the vertical member 42 to pass through gap 108. Thumb button 104 (FIG. 9) is pivoted to control the length of gap 108.

Figure 9:
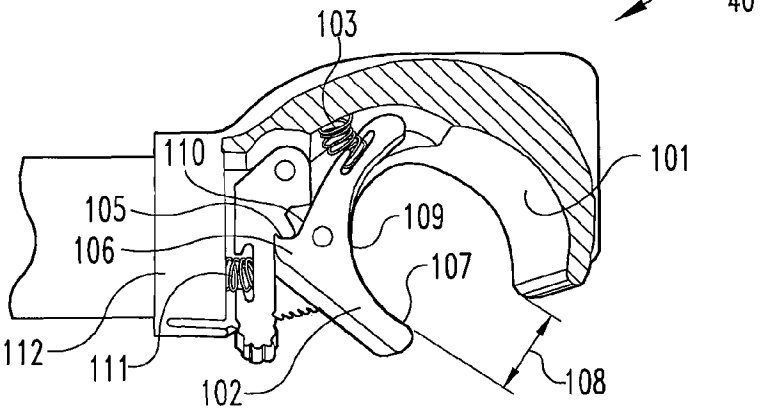
FIG. 9 is a fragmentary, enlarged view of the handled end of the diagonal member of FIG. 5.

Hand 40 is shown in the closed position in FIG. 9 with gap 108 having a minimum length preventing disengagement of the hand from vertical member 42. Projection 105 of button 104 is located in recess 110 of finger 102 with projection 106 of finger 102 abutting button 104 locking the hand in the closed position. By pivoting button 104 in a clockwise direction thereby compressing spring 111 located between the button and flange 112, projection 105 disengaging recess 110 allowing spring 103 to move finger 102 to move in a clockwise position as viewed in FIG. 9, and increasing the length of gap 108 allowing disengagement of the hand from vertical member 42. To reinstall the hand on the vertical member, the hand is moved through gap 108 contacting the inner end of finger 102 snapping the hand to the closed position.

Diagonal member 38 adds rigidity to the truss. Truss 21 includes a single diagonal member 38 extending at the top of the truss; however, the bottom of the truss does not include a similar diagonal member.

Figure 4:
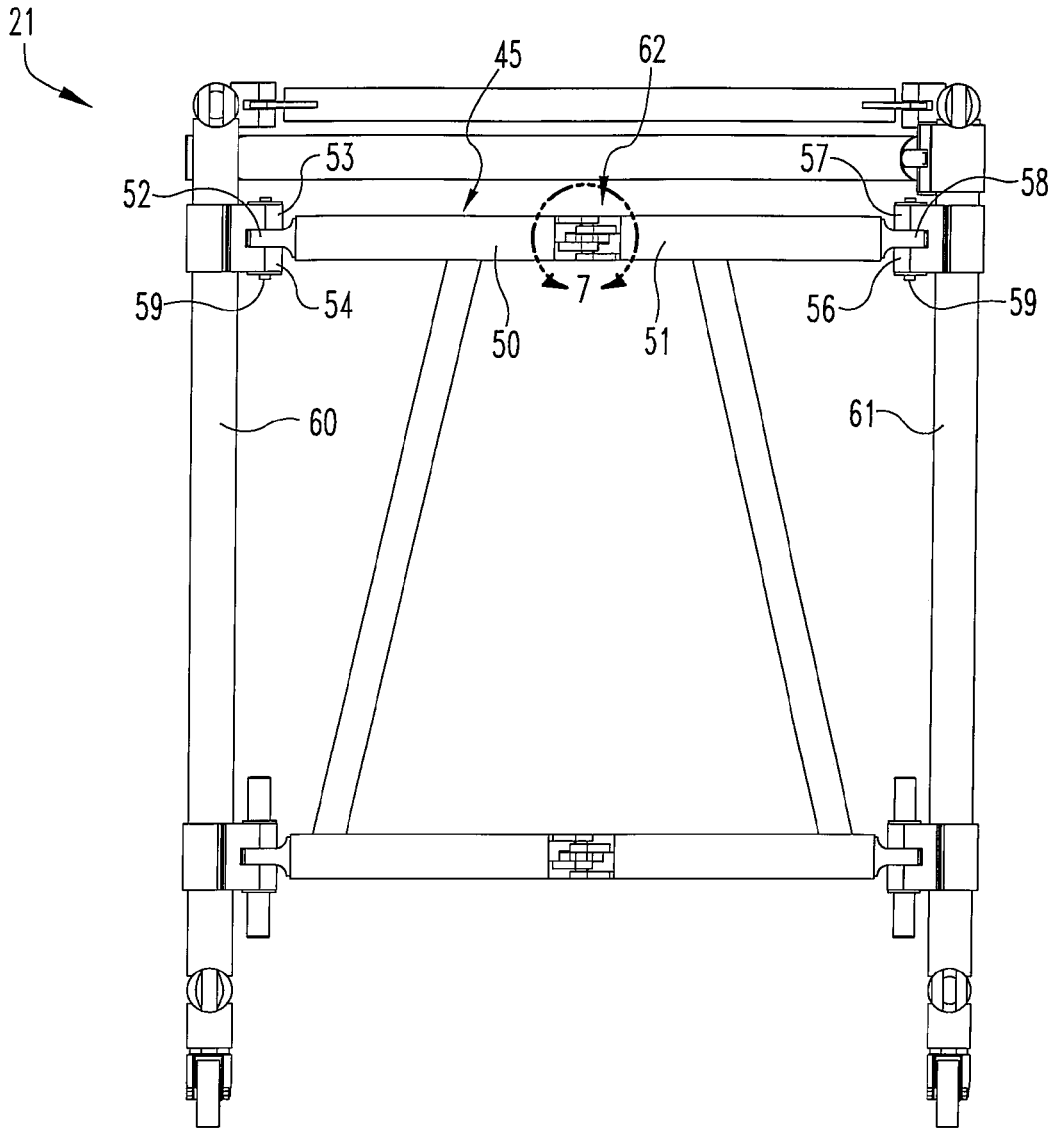
FIG. 4 is an enlarged right end view locking in the direction of arrows 4-4 of FIG. 1 of truss 21 dis-connected from truss 22.

Three foldable supports 43 through 45 are pivotally mounted at the top of truss 21. In addition, three foldable supports 46 through 48 are pivotally mounted to the bottom of truss 21. Foldable support 45 will now be described it being understood that an identical description applies to the foldable supports 43 through 48. Foldable support 45 includes a pair of tube shaped members 50 and 51 (FIG. 4) having their opposite ends 52 and 58 respectively, pivotally mounted between flanges 53, 54 fixedly mounted to vertical member 60 and between flanges 56 and 57 fixedly mounted to vertically extending member 61. Pins 59 extend through flanges 52, 53, 54 and 56, 57, and 58. The adjacent ends of rod members 50 and 51 are hinged together by hinge 62 allowing support 45 to be folded and allowing side frame 31 to move inwardly toward and adjacent to side frame 30 without either side frames 30 or 31 moving along the longitudinal axis 94. Hinge 62 is located equidistant between the outer flanges or ends 52 and 58 of the rod members 50 and 51.

Figure 7:
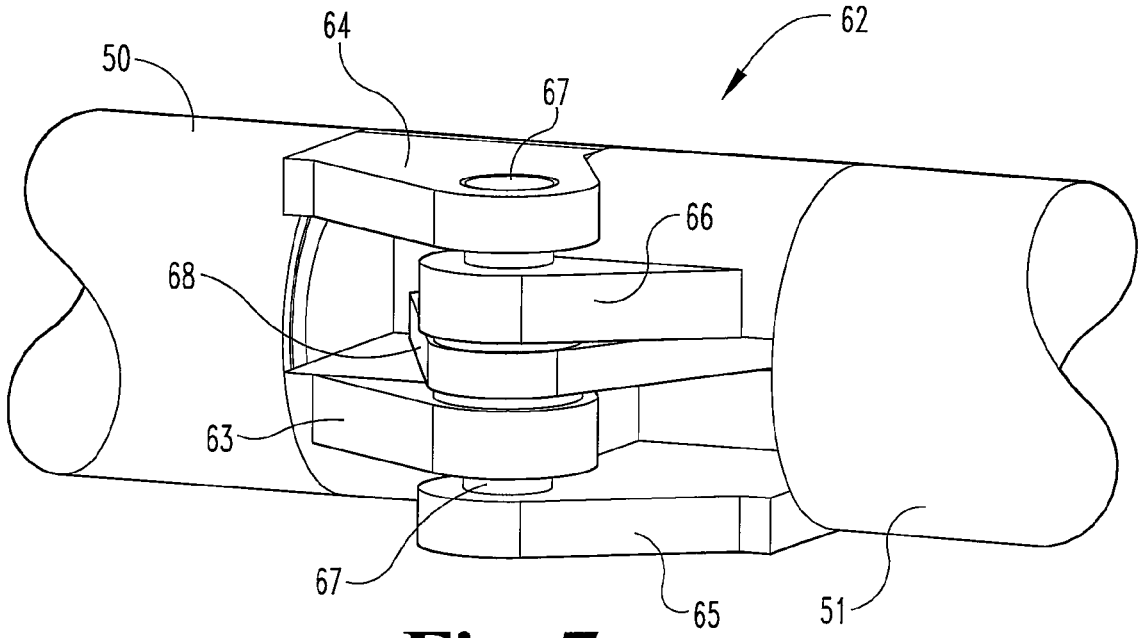
FIG. 7 is a fragmentary, enlarged view of the hinge on foldable cross member 45 enclosed by arrow 7 of FIG. 4.

Locking elbow hinge 62 is a commercially available hinge and forms part of the prior art. The hinge is available from Aliscaff Ltd, Kenrich House, Elizabeth Way, Harlow, Essex, CM19 5TL, United Kingdom. Hinge 62 includes a pair of flanges 63, 64 (FIG. 7) fixedly mounted to the inner end of rod member 50 and a pair of flanges 65, 66 fixedly mounted to the inner end of rod member 51 so that flange 63 is positioned between flanges 65, 66 and flange 66 is positioned between flanges 63, 64. A pin 67 extends through flanges 63 through 66 joining members 50 and 51 together. Flanges 63 through 66 are positioned on the outer side of members 50 and 51 allowing the inner adjacent ends of members 50 and 51 to pivot inward into truss 21.

Figure 6:
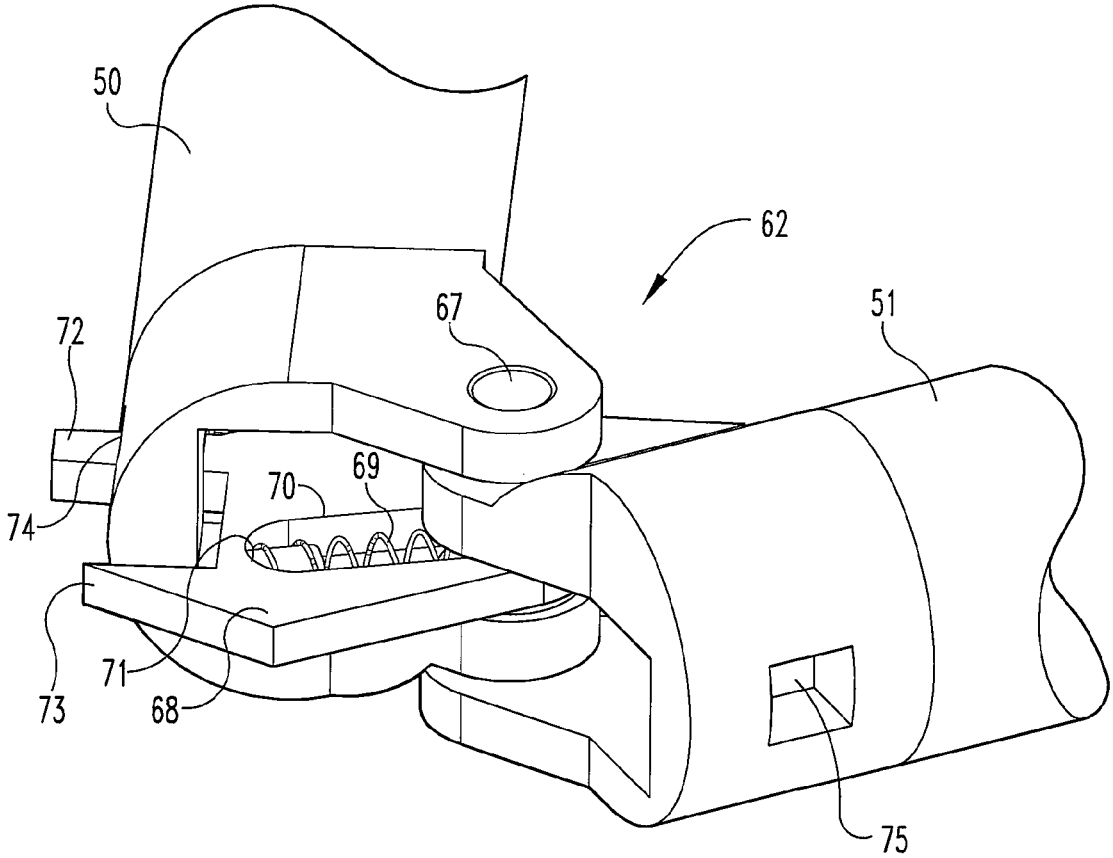
FIG. 6 is a fragmentary, enlarged view of the opposite side of the hinge shown in FIG. 7 in a collapsed state.

A releasable locking plate 68 is slidably mounted to pin 67 and is located within the hollow interior of members 50 and 51. Plate 68 includes a helical spring 69 (FIG. 6) located within slot 70 with one end of the helical end engaging the blind end 71 of slot 70 formed in plate 68 and the opposite spring end located adjacent pin 67. Spring 69 is operable to normally force plate 68 outwardly away from pin 67 so that the spaced apart tips 72 and 73 of the plate extend through respectively holes 74 and 75 of members 50 and 51 releasably locking the members together and preventing the members from pivoting inwardly keeping the truss frame in the non collapsed condition. By manual depressing tip 72 inwardly, spring 69 is compressed allowing the plate to slide inwardly disengaging tip 73 from hole 75 and allowing members 50 and 51 to pivot inwardly. Similarly, truss 21 includes a second foldable support 43 and a third foldable support 44 that are constructed identically to support 45. Supports 43 and 44 are positioned to fold toward foldable support 45 which folds inwardly into truss 21. That is, flanges 63-66 of support 43 and 44 extend from their respective supports to the left as viewed in FIG. 1 whereas flanges 63-66 of support 45 extend from support 45 to the right as viewed in FIG. 1. Thus, flanges 63-66 of supports 43 and 45 face outwardly on truss 21. The bottom supports 46 & 47 are arranged to fold in the same direction as the top supports 43 and 44 whereas bottom support 48 folds in the same direction as top support 45.

A pair of upwardly extending angled rods 98 and 99 (FIG. 1) have opposite ends fixedly and integrally mounted to foldable supports 43 and 46. Thus, when supports 43 and 46 are pivoted inwardly, rods 98 and 99 move with the supports 43 insuring the supports move together. Additional angled rods are mounted in the same manner to foldable supports 44, 47 and 45, 48.

Figure 8:
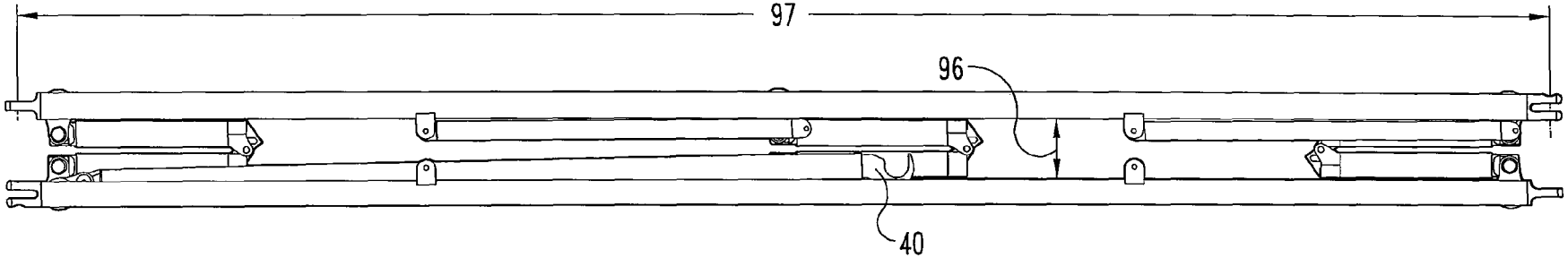
FIG. 8 is the same view as FIG. 3 only showing the truss in a collapsed condition.

In order to collapse the truss, pins 37 (FIG. 1) are removed form one end of each rod 32 and 33 with the rods then swung adjacent and inwardly of the side frame 30 or 31 to which they are attached. Next, hand shaped end 40 (FIG. 5) of diagonal member 38 is slipped off of vertical member 42 with the diagonal member then swung adjacent and inwardly of side frame 31. Tip 72 (FIG. 6) of plate 68 is then moved inwardly for each hinge 62 of foldable supports 43-48 (FIG. 1) and side frames 30 and 31 are moved toward each other reducing the width of the truss from width 95 (FIG. 1) to width 96 (FIG. 8) while supports 43-48 are collapsed to be entirely within the truss thereby insuring the collapsed truss does not increase in length 97. The side frames 30 and 31 are aligned across from each other while in the expanded position of FIG. 1 and in the collapsed position of FIG. 8. That is, one side frame 30 is located along the truss longitudinal axis 94 in the same location as the other side frame 31 regardless of whether the truss is expanded or collapsed. In order to not increase the length of the truss when in the collapsed position, the foldable supports 43-48 are positioned entirely between the pair of side frames 30 and 31 whether in the locked in-use, expanded position whereat the foldable supports extend in a straight line from one side frame to the aligned opposite side frame or in the unlocked, folded or collapsed position. The truss may therefore be transported while having a decreased width and a length that is maintained constant from the expanded position.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A foldable truss having a first truss end and an opposite second truss end with a horizontal longitudinal axis extending from said first truss end to said second truss end and so configured so that the length of the truss along said axis is maintained from an erect position to a folded position comprising:

a first side frame having its longest extension being in a horizontal direction;

a second side frame having its longest extension being in a horizontal direction;

a first foldable support having a first support end and an opposite second support end, said first support end is movably mounted to said first side frame and said second support end is movably mounted to said second side frame, said support extends from said first side frame to said second side frame aligning said first side frame and second side frame across from each other wherein the truss has a length and spacing said first side frame and said second side frame apart wherein the truss has a width, a first hinge located on said first support between said first support end and said second support end having a locked in-use position maintaining said width and said length and an unlocked position wherein said first side frame and said second side frame move toward each other for storage decreasing said width while maintaining said length constant, said first support remaining entirely between said first side frame and said second side frame with said hinge both in the locked in-use position and said unlocked position and said truss respectively is in an erect position and a folded position, and, a diagonally extending member located between said first side frame and said second side frame both when said truss is in an erect position and in a folded position, said diagonally extending member having a first end pivotally mounted to said first side frame at the first truss end and an opposite second end shaped as a hand to removably engage said second side frame at a location between the first truss end and the second truss end, said second end shaped as a hand when disengaged with said second side frame positioned between the first truss end and the second truss end as said first side frame and said second side frame are moved toward each other maintaining said length while said width is decreased.

2. The truss of claim 1 and further comprising:

a second foldable support having a third end and an opposite fourth end, said third end is movably mounted to said first side frame and said fourth end is movably mounted to said second side frame, said second support extends from said first side frame to said second side frame aligning said first side frame and second side frame across from each other wherein the truss has said length and spacing said first side frame and said second side frame apart wherein the truss has said width, a second hinge located on said second support between said third end and said fourth end having a locked in-use position maintaining said width and said length and an unlocked position wherein said first side frame and said second side frame move toward each other when said first hinge and said second hinge are unlocked for storage decreasing said width while maintaining said length constant, and, a cross member with one end removably engaged with said second side frame and another end pivotably mounted to said first side frame, said cross member extending perpendicularly relative to said first side frame and said second side frame when said one end is engaged with said second side frame whereas when disengaged therefrom moving to a position between said first side frame and said second side frame as said truss is collapsed maintaining said length while said width is decreased.

3. The truss of claim 2 wherein said first hinge is located equidistant between said first support end and said second support end and said second hinge is located equidistant between said third end and said fourth end.

4. The truss of claim 3 wherein said first side frame has a first top member and a first bottom member, said second side frame has a second top member and a second bottom member, said first top member and second top member extending with said first bottom member and second bottom member parallel to the longitudinal axis;

said first foldable support located on or adjacent said first top member and second top member and said second foldable support located on or adjacent said first bottom member and second bottom member and extending perpendicular thereto when in an in-use locked position.

5. The truss of claim 4 and further comprising:

a third foldable support mounted on said first side frame and said second side frame and extending therebetween;

a fourth foldable support mounted on said first side frame and said second side frame and extending therebetween; and wherein:

said first foldable support and said third foldable support are positioned respectively at a first truss end and at a second truss end of the truss and fold inwardly when collapsed to maintain the length of the truss constant when in a folded condition, said fourth foldable support is positioned between said first foldable support and said third foldable support and folds toward said third foldable support when collapsed.

6. The truss of claim 5 wherein each foldable support has opposite ends pivotally mounted to said first side frame and said second side frame.

7. The truss of claim 1 and further comprising:

a third side frame removably connected to said first side frame;

a fourth side frame removably connected to said second side frame with said first, second, third and fourth side frames extending parallel to the longitudinal axis of the truss;

a second foldable support having a third end and an opposite fourth end, said third end is movably mounted to said third side frame and said fourth end is movably mounted to said fourth side frame, said second foldable support extends from said third side frame to said fourth side frame aligning said third side frame and fourth side frame across from each other wherein the truss has a certain length and spacing said third side frame and said fourth side frame apart wherein the truss has a certain width, a second hinge located on said second support between said third end and said fourth end having a locked in-use position maintaining said certain width and said certain length and an unlocked position wherein said third side frame and said fourth side frame move toward each other for storage decreasing said certain width while maintaining said certain length constant, said second support remaining entirely between said third side frame and said fourth side frame with said second hinge both in the locked in-use position and said unlocked position and said truss respectively is in an erect position and a folded position; and, a second diagonally extending member located between said third side frame and said fourth side frame both when said truss is in an erect position and in a folded position, said second diagonally extending member having an end pivotally mounted to said third side frame and an opposite end shaped as a hand to removably engage said fourth side frame, said second diagonally extending member remaining between said third side frame and said fourth side frame when disengaged with said fourth side frame as said third side frame and said fourth side frame are moved toward each other maintaining said length while said width is decreased.

8. A foldable truss having a horizontally extending longitudinal axis, said truss has width and further has a length which is the same when the truss is fully erected and when folded and collapsed comprising:

side frames including a first side frame and a second side frame extending in a direction of a horizontally extending longitudinal axis of the truss;

a first top arm with top opposite ends pivotally mounted to respectively said first side frame and said second side frame, said arm has a first top bendable elbow between said top opposite ends; and, a first bottom arm with bottom opposite ends pivotally mounted to respectively said first side frame and said second side frame, said bottom arm has a first bottom bendable elbow between said bottom opposite ends;

a cross member with one end removably engaged with said second side frame and another end pivotably mounted to said first side frame, said cross member extending perpendicularly relative to said first side frame and said second side frame when said one end is engaged with said second side frame whereas when disengaged therefrom moving to a position between said first side frame and said second side frame as said truss is collapsed maintaining said length while said width is decreased; and, a diagonally extending member located between said first side frame and said second side frame both when said truss is in an erect position and in a folded position, said diagonally extending member having a first end pivotally mounted to one of said side frames and a second end shaped as a hand removably engaged with another of said frames between opposite ends of the truss; and wherein:

said top bendable elbow and said bottom bendable elbow extend straight in a direction from said first side frame to said second side frame whereas said diagonally extending member extends diagonally between said side frames aligning said first side frame and said second side frame across from each other at a fixed width and a fixed length, said diagonally extending member, said top bendable elbow and said bottom bendable elbow are collapsible within the truss along the longitudinal axis allowing said first side frame and said second side frame to move adjacent each other reducing said width while maintaining said length constant along the longitudinal axis for transporting in a collapsed state.

9. The foldable truss of claim 8 and further comprising:

a second top arm with second top opposite ends pivotally mounted to respectively said first side frame and said second side frame, said second arm has a second top bendable elbow between said second top opposite ends; and, a second bottom arm with second bottom opposite ends pivotally mounted to respectively said first side frame and said second side frame, said second bottom arm has a second bottom bendable elbow between said second bottom opposite ends; and, wherein:

said second top bendable elbow and said second bottom bendable elbow extend straight in a direction from said first side frame to said second side frame aligning said first side frame and said second side frame across from each other at a fixed width and a fixed length, said second top bendable elbow and said second bottom bendable elbow are collapsible within the truss along the longitudinal axis allowing said first side frame and said second side frame to move adjacent each other reducing said width while maintaining said length constant along the longitudinal axis for transporting in a collapsed state.

10. The foldable truss of claim 9 wherein:

said first top elbow bends inwardly on the truss along said longitudinal axis in an opposite direction that said second top elbow bends; and, said first bottom elbow bends inwardly on the truss along said longitudinal axis in an opposite direction that said second bottom elbow bends.

11. A truss having a longitudinal axis and comprising:

a first pair of frames extending parallel to the longitudinal axis of the truss and being in alignment with each other, said truss has width and further has a fixed length which is the same when the truss is fully erected and when folded and collapsed;

a cross member with one end removably engaged with one of said frames and another end pivotably mounted to another of said frames, said cross member extending perpendicularly relative to said frames when said one end is engaged with said one frame whereas when disengaged therefrom moving to a position between said frames as said truss is collapsed maintaining said length while said width is decreased;

a diagonally extending member located between said frames both when said truss is in an erect position and in a folded position and having a first end pivotally mounted to one of said frames and an opposite second end shaped as a hand to removably engage the other of said frames, said second end shaped as a hand when disengaged from said other of said frames remaining between said frames as said frames are moved toward each other with the foldable truss maintaining the length while the width is decreased; and, an arm having opposite ends extending between and movably attached to said pair of frames, said arm having a bendable portion between said opposite ends, said arm having a first position positioning said pair of frames apart a first distance in alignment with each other and a second position wherein said bendable portion bends positioning said pair of frames apart a second distance less than said first distance while maintaining said fixed length, said pair of frames when in said second position being located along said axis with said bendable portion located entirely between said pair of frames while maintaining said alignment.

12. The truss of claim 11 and further comprising:

a second pair of frames extending parallel to the longitudinal axis of the truss and being in alignment with each other, said second pair of frames being removably mounted to said first pair of frames; and, a second arm having second opposite ends extending between and movably attached to said second pair of frames, said second arm having a second bendable portion between said second opposite ends, said second arm having a third position positioning said second pair of frames apart said first distance in alignment with each other and when in a fourth position said second bendable portion bends positioning said second pair of frames apart said second distance, said second pair of frames when in said second position being located along with said second bendable portion entirely between said second pair of frames while maintaining said alignment.

13. The truss of claim 12 and further comprising an additional arm identical to said first arm and having a bendable portion with each arm pivotally mounted to said first and second pair of frames to maintain said first distance when in a straight condition while maintaining said second distance and alignment when collapsed.

14. The truss of claim 13 and further comprising:

a second cross member with an end pivotally mounted to one of said second pair of frames and a hand shaped opposite second end removably grasping another one of said second pair of frames.

* * * * *